US011095079B2

(12) United States Patent
Hasenöhrl et al.

(10) Patent No.: US 11,095,079 B2
(45) Date of Patent: Aug. 17, 2021

(54) ELECTRICAL CONNECTOR AND METHOD FOR ASSEMBLING AN ELECTRICAL CONNECTOR

(71) Applicant: Rosenberger Hochfrequenztechnik GmbH & Co. KG, Fridolfing (DE)

(72) Inventors: Ulrich Hasenöhrl, Ainring (DE); Manuel Pemwieser, Tittmoning (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 16/827,810

(22) Filed: Mar. 24, 2020

(65) Prior Publication Data

US 2020/0227873 A1 Jul. 16, 2020

Related U.S. Application Data

(63) Continuation of application No. 16/150,315, filed on Oct. 3, 2018, now Pat. No. 10,608,388.

(30) Foreign Application Priority Data

Oct. 5, 2017 (DE) ..... 10 2017 123 080.7

(51) Int. Cl.
*H01R 9/05* (2006.01)
*H01R 24/50* (2011.01)
(Continued)

(52) U.S. Cl.
CPC ..... *H01R 24/50* (2013.01); *H01R 12/724* (2013.01); *H01R 13/502* (2013.01);
(Continued)

(58) Field of Classification Search
CPC .... H01R 24/50; H01R 13/645; H01R 13/506; H01R 12/724; H01R 13/64; H01R 13/6272; H01R 13/502; H01R 2201/26
(Continued)

(56) References Cited

U.S. PATENT DOCUMENTS 5,779,495 A * 7/1998 Dechelette ..... H01R 13/6275 439/353
6,319,016 B1 * 11/2001 Juntwait ..... H01R 24/50 439/521
(Continued)

FOREIGN PATENT DOCUMENTS

DE 20 2008 014 541 U1 3/2009
EP 0 887 892 A1 12/1998
(Continued)

*Primary Examiner* — Abdullah A Riyami
*Assistant Examiner* — Nelson R. Burgos-Guntin
(74) *Attorney, Agent, or Firm* — David P. Dickerson

(57) ABSTRACT

The invention relates to an electrical connector (2) comprising a coding housing (4) for electrical and mechanical connection to a compatible connector (3) and comprising a plug body (6) for electrical and mechanical connection to an electrical assembly (5, 14, 15, 16), wherein the compatible connector (3) can be connected to the coding housing (4) along an insertion direction (A), and wherein the coding housing (4) and the plug body (6) have a mechanical connecting device (8). It is provided that the connecting device (8) is designed in order to connect the coding housing (4) and the plug body (6) to one another in an interlocking manner in the insertion direction (A), wherein the connecting device (8) prespecifies an assembly movement (B), which differs from the insertion direction (A), in order to connect the coding housing (4) and the plug body (6) to one another.

20 Claims, 6 Drawing Sheets

(51) Int. Cl.

| | |
|---|---|
| ***H01R 13/645*** | (2006.01) |
| ***H01R 13/506*** | (2006.01) |
| ***H01R 12/72*** | (2011.01) |
| ***H01R 13/502*** | (2006.01) |
| ***H01R 13/627*** | (2006.01) |
| ***H01R 13/64*** | (2006.01) |

(52) U.S. Cl.
CPC ..... *H01R 13/506* (2013.01); *H01R 13/6272* (2013.01); *H01R 13/64* (2013.01); *H01R 13/645* (2013.01); *H01R 2201/26* (2013.01)

(58) Field of Classification Search
USPC ..... 439/352, 358, 372, 353, 357, 157
See application file for complete search history.

(56) References Cited

U.S. PATENT DOCUMENTS 6,332,795 B1 * 12/2001 Conorich ..... H01R 13/62933 439/188
6,776,621 B1 * 8/2004 Dye ..... H01R 24/50 439/63
6,948,977 B1 * 9/2005 Behrent ..... H01R 24/50 439/581
7,828,585 B2 * 11/2010 Kurimoto ..... H01R 12/716 439/468
7,887,359 B2 * 2/2011 Manser ..... H01R 13/6272 439/350
8,282,415 B1 * 10/2012 Foltz ..... H01R 13/514 439/579
9,033,733 B2 * 5/2015 Takahashi ..... H01R 4/185 439/585
10,862,247 B2 * 12/2020 Hashimoto ..... H01R 24/50
2001/0021604 A1 9/2001 Held et al.
2006/0270253 A1 11/2006 Skowranek
2016/0164232 A1 * 6/2016 Lane ..... H01R 24/50 439/578
2016/0164233 A1 * 6/2016 Zhu ..... H01R 24/50 439/248
2018/0366843 A1 * 12/2018 Maki ..... H01R 13/6315
2018/0366844 A1 * 12/2018 Beganovic ..... H01R 9/0515
2020/0028296 A1 * 1/2020 Ibarra ..... H01R 13/641
2020/0161789 A1 * 5/2020 Flaherty, IV ..... H01R 13/2421
2020/0243992 A1 * 7/2020 Annequin ..... H01R 12/724
2020/0274265 A1 * 8/2020 Hashimoto ..... H01R 13/6583

FOREIGN PATENT DOCUMENTS

KR 200225804 Y1 6/2001
WO 01/04995 A1 1/2001

* cited by examiner

ELECTRICAL CONNECTOR AND METHOD FOR ASSEMBLING AN ELECTRICAL CONNECTOR

FIELD OF THE INVENTION

The present disclosure relates to an electrical connector, in particular to an electrical connector comprising a coding housing for electrical and mechanical connection to a compatible connector and comprising a plug body for electrical and mechanical connection to an electrical assembly.

The present disclosure also relates to a method for assembling an electrical connector, in particular to a method for assembling an electrical connector which has a coding housing for electrical and mechanical connection to a compatible connector and has a plug body for electrical and mechanical connection to an electrical assembly.

TECHNICAL BACKGROUND

Connectors serve to establish an electrical and mechanical connection to a correspondingly compatible or complementary further connector. A connector may be a plug, a socket, a coupling or an adapter. The term "connector" used within the scope of the present disclosure is representative of all variants.

Connectors are usually secured on printed circuit boards (PCBs), as interfaces to device housings or to electrical cables and facilitate access to electrical signals (data and/or electrical power supply) of the corresponding electrical assembly. To this end, the connectors generally have a plug body which is electrically and mechanically connected to the electrical assembly, for example a printed circuit board. A coding housing, which essentially serves for connection to a compatible connector, generally adjoins the plug body. The coding housing therefore constitutes the interface to the compatible connector and, to this end, is matched to the compatible connector for example in terms of the arrangement and number of electrical contact bodies and/or signal conductors/inner conductors and earth conductors/outer conductors and also in respect of its mechanical coding.

In principle, connectors should be designed to be mechanically robust and, respectively, have a long service life. In particular, the connectors should be able to withstand several insertion and removal operations or forces acting in or counter to the insertion direction, forces acting orthogonally in relation to the insertion direction and torsion forces without being damaged here. In addition, a connector should provide good electrical properties, including ensuring a sufficiently high degree of electromagnetic shielding, low contact resistances and vibration-resistant contact-connection, primarily if the connector is intended to be suitable for radiofrequency technology.

SUMMARY OF THE INVENTION

In light of this background, the present disclosure aims to provide an improved electrical connector which is particularly suitable for advantageously absorbing mechanical forces along or counter to the insertion direction, wherein the connector is as insensitive as possible to manufacturing tolerances.

The present disclosure furthermore aims to provide a method for assembling an electrical connector, as a result of which, in particular, a mechanically robust electrical connector which is insensitive to tolerances can be provided.

In light of these aims, the present disclosure teaches a connector assembly, comprising a first connector; a second connector; and a third connector, wherein said first connector is matingly engageable with said second connector by a motion of said first connector in a first direction defined by said second connector, said third connector is matingly engageable with said second connector by a motion of said third connector in a second direction defined by said second connector, said second direction differing from said first direction, and in an engaged state of said second connector and said first connector, said second connector resists separation from said first connector in response to a force in any direction parallel to said second direction.

In light of these aims, the present disclosure moreover teaches an electrical connector assembly method, comprising matingly engaging a first connector with a second connector by a motion of said first connector in a first direction defined by said second connector, and matingly engaging a third connector with said second connector by a motion of said third connector in a second direction defined by said second connector, said second direction differing from said first direction, wherein said first connector and said second connector are configured such that, in an engaged state of said second connector and said first connector, said second connector resists separation from said first connector in response to a force in any direction parallel to said second direction.

The electrical connector according to the present disclosure may comprise a coding housing for electrical and mechanical connection to a compatible connector and comprises a plug body for electrical and mechanical connection to an electrical assembly, wherein the compatible connector can be connected to the coding housing along an insertion direction.

The coding housing is designed in such a way that the compatible connector can be electrically and mechanically connected to the coding housing in the insertion direction.

Therefore, the coding housing can provide a mechanical coding for the compatible connector or for a corresponding coding housing of the compatible connector. The coding housing therefore constitutes the plug-side part of the connector.

The coding housing is preferably formed from a plastic or from an electrically non-conductive material.

The insertion direction of the compatible connector usually runs along or at least in parallel to the center axis or the longitudinal axis of the coding housing of the electrical connector.

The electrical assembly to which the plug body can be connected may be, for example, an electrical cable, an adapter part, a device housing or preferably an electrical printed circuit board. In principle, the invention is not intended to be understood as being restricted to use with a specific electrical assembly. For simplification purposes, the teachings of the present disclosure are described below substantially with reference to a printed circuit board or printed circuit connector, the plug body of which is electrically and mechanically connected to an electrical assembly which is designed as a printed circuit board. It goes without saying that this is not intended to be understood as being limiting.

According to the present disclosure, the coding housing and the plug body have a mechanical connecting device. In this case, it is provided that the connecting device is designed in order to connect the coding housing and the plug body to one another in an interlocking manner in the insertion direction, wherein the connecting device prespecifies an assembly movement, which differs from the insertion direction, in order to connect the coding housing and the plug body to one another.

Therefore, the coding housing is not mounted onto the plug body along the insertion direction. In this way, an interlocking connection can advantageously be provided in the insertion direction.

The coding housing can be fitted onto the plug body along an assembly path which differs from a path which the compatible connector has to follow during insertion into the coding housing.

On account of the connecting device of the coding housing and of the plug body providing an interlocking connection at least in the insertion direction, the coding housing can then no longer be moved relative to the plug body along one degree of freedom in the insertion direction; the coding housing and the plug body are connected to one another in an interlocking or fixed manner in the insertion direction. In this case, possible tolerances or play of the connecting device can be ignored and do not have a disruptive effect on the interlocking connection. One particular advantage is that no additional latching means or the like are required for connecting the coding housing to the plug body in an interlocking manner (in the insertion direction).

Owing to the connecting device, traction forces which are produced particularly when the compatible connector which is inserted into the coding housing is pulled, and also sometimes even transverse force components with respect to the insertion direction, can be transmitted to the plug body which, for its part, is connected to the electrical assembly in a fixed manner. Therefore, a critical traction force can advantageously be absorbed by means of the electrical assembly. This solution prevents the connection between the coding housing and the plug body being damaged or released when traction forces occur.

The connection between the coding housing and the plug body is extraordinarily robust in or counter to the insertion direction, in particular compared with an only force-fitting connection of the prior art.

Furthermore, the connecting device may comprise a rail system, wherein the coding housing and the plug body each have at least one guide rail, which guide rails correspond to one another and together form the rail system.

Instead of a rail system, any desired guide which ensures that at least the degree of freedom in the insertion direction is blocked when the coding housing is connected to the plug body can also be provided.

A rail system has proven to be particularly advantageous in order to fit the coding housing onto the plug body with a pushing-on assembly movement, wherein the assembly movement differs from the insertion direction of the compatible connector.

Owing to a rail system, a further interlocking connection may optionally be provided orthogonally in relation to the insertion direction, as a result of which even two degrees of translatory freedom between the coding housing and the plug body can be blocked.

As an alternative or in addition, a connecting device in the form of a bayonet fitting can also be provided, as a result of which the coding housing can be fitted onto the plug body by virtue of a rotational assembly movement. However, for the purpose of simplifying assembly, a connecting device in the form of a rail system is preferred.

In some embodiments, it can be provided that two guide rails which run in parallel and on opposite sides are arranged in the coding housing and in the plug body in each case.

In principle, any desired number of guide rails can be provided in the coding housing and the plug body, in particular even only one single guide rail in the coding housing and the plug body in each case.

However, particularly good guidance can be achieved by virtue of at least two guide rails which run in parallel in the coding housing and in the plug body in each case. In this case, it may be particularly advantageous (but not absolutely necessary) to space the guide rails which run in parallel as far from one another as possible, in particular to provide two guide rails at opposite ends of one side of the coding housing and two corresponding guide rails at opposite ends of one side of the plug body. Therefore, guide rails which run in parallel are preferably provided at the ends/edges of the sides of the coding housing and of the plug body which are to be combined.

The guide rails can, for example, correspond to one another by firstly (in the coding housing or in the plug body) a groove and secondly (in the plug body or in the coding housing) a web which engages behind the groove being provided. As an alternative or in addition, a rail system can also be realized by a clamp-like design of the coding housing or of the plug body, as a result of which the respective mating piece can be directly guided.

In some embodiments, it can be provided that the connecting device comprises an end stop which defines an end position of the coding housing on the plug body for the assembly movement.

The assembly process, in particular the orientation of the coding housing and of the plug body relative to one another in preparation for possible further assembly steps, can be particularly advantageously carried out by the use of an end stop. The end stop can preferably be configured in such a way that the coding housing can be pushed onto the plug body only as far as an intended end position. Therefore, a further interlocking connection can be provided. Therefore, in combination with a rail system, it can be provided that only one degree of translatory freedom remains between the coding housing and the plug body after the pushing-on operation, as a result of which only a movement of the coding housing on the plug body counter to the pushing-on direction is possible.

In some embodiments, it can particularly be provided that the assembly movement takes place along an assembly angle, wherein the assembly angle is 30° to 150°, preferably 45° to 135°, particularly preferably 80° to 100° and very particularly preferably 90°, relative to the insertion direction.

An assembly movement, for example a pushing-on operation along a rail system, orthogonally or at least approximately orthogonally in relation to the insertion direction of the compatible connector is particularly suitable. When a rail system which is oriented orthogonally or through 90° in relation to the insertion direction is used, a particularly suitable interlocking connection in the insertion direction can be inherently produced as a result.

In some embodiments, recesses for at least one contact body can be provided in the coding housing and in the plug body in order to introduce the at least one contact body into the plug body through the coding housing in the insertion direction, wherein the contact body and the recesses are created in such a way that the coding housing and the plug body are fixed in their position by virtue of the insertion of the contact body.

The at least one contact body can be arranged in or preferably clamped into the recesses of the coding housing or of the plug body in such a way that the coding housing can no longer be moved on the plug body and, respectively, can no longer be removed from the said plug body.

The contact body may be any desired electrical conductor which can be used, for example, as an inner conductor or signal conductor or, in particular, as an outer conductor or earth conductor of the inventive connector.

The positioning of the coding housing relative to the plug body can therefore be defined by the at least one contact body.

In principle, the contact body does not necessarily have to be introduced along the insertion direction, but rather can also be introduced along an angle which is 30° to 150°, preferably 45° to 135° and particularly preferably 80° to 100° relative to the assembly movement. However, the angle is very particularly preferably 90° and runs along the insertion direction.

The contact body and the corresponding recesses for the contact body can have any desired geometry, in particular the at least one contact body can have a round, a rectangular (in particular square) or any other cross section. The contact body can be of solid or hollow construction, in particular of tubular form, and can possibly also be called a contact sleeve.

On account of the connecting device providing an interlocking connection in the insertion direction and therefore blocking at least the degree of translatory freedom in the insertion direction, all remaining degrees of freedom can be blocked by the introduction of the at least one contact body in the insertion direction. The coding housing and the plug body are therefore preferably connected to one another in an interlocking manner in all spatial directions after the introduction of the contact body.

In addition to fixing the relative position between the coding housing and the plug body, optimum orientation of the contact body in relation to the plug body can also take place owing to the introduction of the at least one contact body. Since the at least one contact body is directly electrically and mechanically connected to the plug body by passing through the recess in the coding housing, the tolerance chain for the connector can be substantially improved. Finally, it is possible to ensure narrow tolerances in the interface and, respectively, in the connector without particular measures having to be taken during the production of the connector. Therefore, the production of the electrical connector can be particularly economical.

A contact end stop can be provided in the plug body for the at least one contact body. As an alternative or in addition, the at least one contact body can have a cross section which is preferably gradually reduced in the direction of the plug body in order to itself form a stop for the pushing-in operation if the recess or recesses in the contact body has or have a larger diameter than the corresponding recess or recesses in the plug body.

In some embodiments, it can be provided that the plug body is designed to receive one or more inner conductor parts, wherein the at least one contact body is designed as a tubular outer conductor and to receive at least one of the several inner conductor parts.

Therefore, at least one coaxial line or one shield of one or more inner conductors can advantageously be provided by a contact body, which is designed as an outer conductor, within the electrical connector.

In some embodiments, it can further be provided that the coding housing and/or the plug body are/is designed in order to receive one to ten contact bodies, preferably two to six contact bodies and very particularly preferably four contact bodies.

In particular, the teachings of the present invention can be used with one contact body, two contact bodies or four contact bodies, in particular when the contact body is designed as a tubular outer conductor for receiving a corresponding number of inner conductors.

In some embodiments, it can also be provided that the plug body is designed from metal, preferably as a die-cast zinc part, and is electrically conductively connected to the at least one contact body.

Particularly when the at least one contact body is used as an outer conductor, the design of the plug body from metal is particularly advantageous for jointly making contact with all of the contact bodies and for electromagnetically shielding the inner conductor parts which are passed through the plug body.

In some embodiments, the plug body can be, as already mentioned above, designed for electrical and mechanical connection to an electrical assembly which is designed as a printed circuit board, electrical cable, adapter part or device housing.

An adapter part is intended to be understood to mean, in particular, an adapter coding housing which has, for example, a mechanical coding, which differs from the compatible connector, or electrical configuration and into which a corresponding connector can be inserted. In this case, the adapter coding housing can possibly also be connected to the plug body of the connector by means of a further mechanical connecting device, for which purpose a further rail system can be provided for example.

In some embodiments, the coding housing may have latching means for latching connection to the compatible connector.

In this way, it is possible to prevent undesired traction forces counter to the insertion direction leading to unplugging of the compatible connector and rather being transmitted to the coding housing and, by way of the connecting device, directly to the plug body and therefore to the electrical assembly and being captured.

The plug body and/or the coding housing can be designed in a straight or angled manner; the teachings of the present disclosure can therefore be equally used for a straight and for an angled connector. The only important factor as taught in this disclosure is that the assembly movement for the coding housing and the plug body differs from the insertion direction of the compatible connector.

The teachings of the present disclosure can also be advantageously used for providing a modular construction set comprising coding housings which can be connected to a uniform plug body by a fitter as required. Therefore, the fitter can very easily create different configurations or variations of the electrical connector with the same and possibly even pre-mounted plug body.

It can be provided that, in addition to the at least one inner conductor part, an insulating material layer which surrounds the inner conductor part is introduced at least into the plug body, which insulating material layer holds the at least one inner conductor part in position and prevents short circuits with further inner conductor parts and/or an earth line.

The teachings of the present disclosure are not restricted to a specific type of connector or to a specific connector, yet are particularly suitable for manufacturing RF cables. In this case, the connector can preferably be designed as an RF connector, in particular as a PL connector, BNC connector, TNC connector, SMBA(FAKRA) connector, N connector, 7/16 connector, SMA connector, SMB connector, SMS connector, SMC connector, SMP connector, BMS connector, HFM connector, HSD connector, BMK connector, mini coax connector or Makax connector.

The teachings of the present disclosure also relate to a method for assembling an electrical connector which has a coding housing for electrical and mechanical connection to a compatible connector and a plug body for electrical and mechanical connection to an electrical assembly, wherein the coding housing is mechanically connected to the plug body in one assembly step.

In the method according to the present disclosure, it is provided that the assembly step for establishing the mechanical connection between the coding housing and the plug body comprises an assembly movement of the coding housing relative to the plug body, by way of which assembly movement the coding housing and the plug body are connected to one another in an interlocking manner in the insertion direction of the compatible connector.

Features which have already been described in connection with the connector can of course also be advantageously implemented for the method and, respectively, for the connector system still to be described below—and vice versa. Furthermore, advantages which have already been mentioned in connection with the connector can also be understood to relate to the method and, respectively, to the connector system—and vice versa.

In some embodiments of the method, it can be provided that the assembly movement comprises pushing the coding housing onto the plug body and/or rotating the coding housing in relation to the plug body.

In some embodiments of the method, it can particularly be provided that the coding housing is pushed onto the plug body using the abovementioned rail system, wherein the coding housing and the plug body each have at least one guide rail, which guide rails correspond to one another.

In some embodiments of the method, it can be particularly provided that the pushing-on operation takes place along an assembly angle, wherein the assembly angle is 30° to 150°, preferably 45° to 135°, particularly preferably 80° to 100° and very particularly preferably 90°, relative to the insertion direction.

In respect of rotation of the coding housing, a connecting device in the form of a bayonet fitting can be provided.

In some embodiments of the method, it can be provided that, in a further assembly step, at least one contact body is introduced through corresponding recesses in the coding housing and in the plug body in the insertion direction in such a way that the relative position between the coding housing and the plug body is fixed.

Fine adjustment of the connector can advantageously be performed by using or by introducing the at least one contact body.

In some embodiments, it can be particularly provided that the at least one contact body is pressed, soldered, welded, fused and/or adhesively bonded in the recess of the plug body.

The at least one contact body, which is preferably a contact sleeve, is preferably pressed into the recesses of the plug body.

Here, the manner of fastening the contact body in the plug body is less important than that the at least one contact body is introduced such that the corresponding force-fitting connection (and/or cohesive connection) of the at least one contact body to the plug body exceeds the traction force which acts on the contact body when the compatible connector is unplugged. The contact body can therefore be securely held in position in the plug body.

In some embodiments, it can be provided that, in a further assembly step, at least one inner conductor part is passed through the plug body and received by the at least one contact body.

In a further assembly step, the electrical connector can be fastened to the electrical assembly. By way of example, output-side contacts can be soldered to a printed circuit board or crimped to stranded wires of an electrical cable, as a result of which electrical contact can also be made at the same time.

In principle—depending on the design of the connector—a different order of the described assembly steps can also be provided. By way of example, the plug body can possibly already be pre-mounted on the electrical assembly.

The teachings of the present disclosure also relate to a connector system comprising an electrical connector according to the above embodiments, a compatible connector for electrical and mechanical connection to a coding housing of the connector and an electrical assembly for electrical and mechanical connection to a plug body of the connector.

The present invention and, respectively, the connector according to the invention, the method according to the invention and the connector system according to the invention can be particularly advantageously used in a vehicle. Here, the term "vehicle" describes any means of transportation, in particular land vehicles, watercraft or aircraft, including spacecraft.

It should be noted that the terms such as "comprising", "have" or "having" do not preclude other features or steps. Furthermore, terms such as "a" or "the" which refer to a singular step or feature do not preclude several steps or features.

Exemplary embodiments of the invention are described in more detail below with reference to the drawing. The figures respectively show preferred exemplary embodiments in which individual features of the present invention are illustrated in combination with one another. Features of one exemplary embodiment can also be implemented in a manner detached from the other features of the same exemplary embodiment and can accordingly be readily combined by a person skilled in the art with features of other exemplary embodiments to form further expedient combinations and subcombinations.

In the figures, elements having an identical function are provided with the same reference symbols.

DETAILED DESCRIPTION OF THE INVENTION

Figure 1:
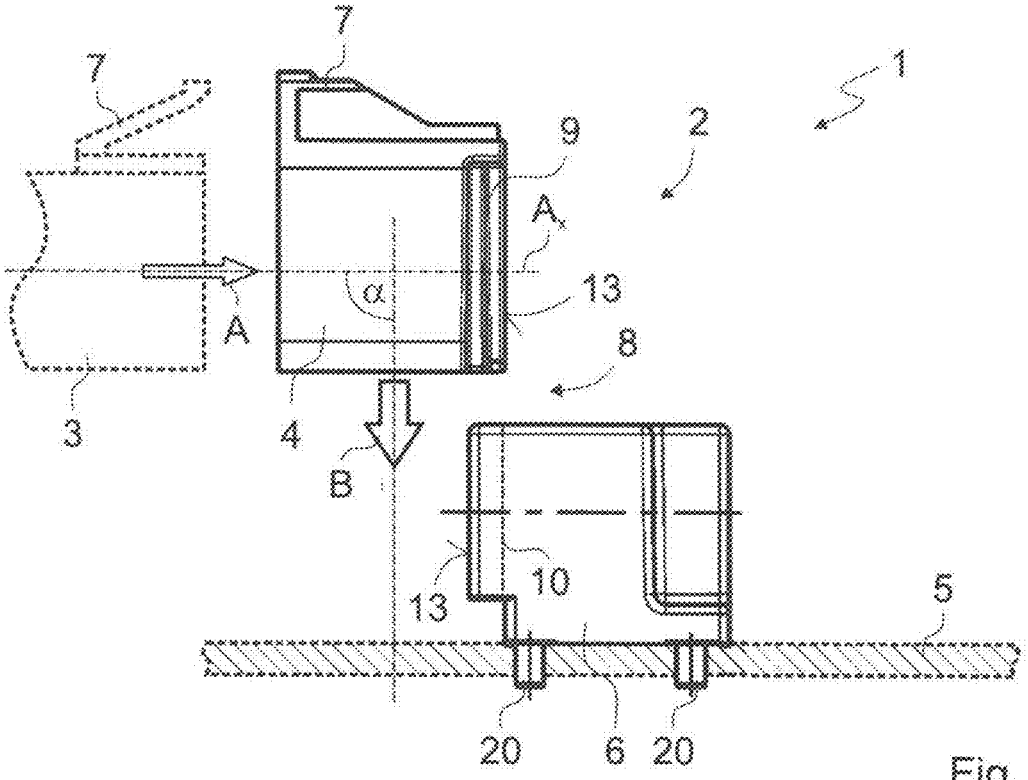
FIG. 1 schematically shows a side view of a connector system in accordance with the teachings of the present disclosure comprising an electrical connector in an embodiment as an angled printed circuit board connector having a coding housing and a plug body, and also comprising a compatible connector and a printed circuit board.

FIG. 1 shows a connector system 1 in accordance with the teachings of the present disclosure comprising an electrical connector 2, a compatible connector 3 for electrical and mechanical connection to a coding housing 4 of the connector 2, and an electrical assembly 5, which is designed as a printed circuit board (illustrated using dashed lines) for electrical and mechanical connection to a plug body 6 of the connector 2.

The compatible connector 3 can be connected to the coding housing 4 along an insertion direction A, indicated by corresponding arrows in the figures, along the axis Ax. The axis Ax is preferably (as is the case in the exemplary embodiment) the longitudinal axis of the coding housing 4.

The compatible connector 3 is illustrated using dashed lines by way of example in FIG. 1. The compatible connector 3 is usually only connected to the connector 2 when the connector 2 is completely assembled. The compatible connector 3 is already illustrated in the non-assembled state of the electrical connector 2 in FIG. 1 merely for illustration purposes and for fully describing the connector system.

In the exemplary embodiment, the compatible connector 3 and the coding housing 4 each have latching means 7 for mutually latching connection. However, the said latching means can, in principle, also be dispensed with or be designed in some other way. The coding housing 4 of the connector 2 can have a mechanical coding and an electrical configuration, which corresponds to the compatible connector 3 or to a coding housing of the compatible connector 3, in order to forward electrical signals (data and power supply) in as optimum a manner as possible and in order to ensure that only a compatible connector 3 can be plug-connected to the connector 2.

The plug body 6 of the embodiment of FIG. 1 is designed for electrical and mechanical connection to a printed circuit board 5. The electrical and mechanical connection can be made, for example, by a soldering contact-connection (cf. FIG. 14). The connector 2 is usually connected to the electrical assembly or to the printed circuit board 5 only after assembly. The printed circuit board 5 is already illustrated in the non-assembled state of the connector 2 in FIG. 1 substantially for illustration purposes.

The coding housing 4 and the plug body 6 have a mechanical connecting device 8 which is designed in order to connect the coding housing 4 and the plug body 6 to one another in an interlocking manner in the insertion direction A, wherein the connecting device 8 prespecifies an assembly movement B, which differs from the insertion direction A, for the coding housing 4 and the plug body 6 (indicated by corresponding arrows in the figures). The connecting device 8 is arranged in the region of the connecting faces 13 of the coding housing 4 and, respectively, of the plug body 6 which are intended to be mechanically connected to one another.

Therefore, during the course of a method for assembling the connector 2, the coding housing 4 can be mechanically connected to the plug body 6 in one assembly step, but usually not necessarily in the first assembly step. This assembly step for establishing the mechanical connection between the coding housing 4 and the plug body 6 in this case comprises an assembly movement B by way of which the coding housing 4 and the plug body 6 are connected to one another in an interlocking manner in the insertion direction A of the compatible connector 3.

The assembly movement B can comprise pushing the coding housing 4 onto the plug body 6 and/or rotating the coding housing 4 in relation to the plug body 6. Only the preferred variant of the pushing-on operation is illustrated in the exemplary embodiments, but this is not intended to be understood to be limiting.

In the exemplary embodiment, the connecting device 8 is designed as a rail system, wherein the coding housing 4 and the plug body 6 have guide rails 9, 10 which correspond to one another and which together form the rail system and, respectively, the connecting device 8. Therefore, the coding housing 4 is pushed onto the plug body 6 using the said rail system. One of the hidden guide rails 10 of the plug body 6 is indicated as a dashed line in FIG. 1.

It can be provided that the mounting movement B or pushing the coding housing onto the plug body takes place along an assembly angle $\alpha$, wherein the assembly angle $\alpha$ is 30° to 150°, preferably 45° to 135°, particularly preferably 80° to 100° and very particularly preferably 90°, relative to the insertion direction A. In the exemplary embodiment, an assembly angle $\alpha$ of 90° is used throughout, this having proven particularly suitable for the interlocking connection in the insertion direction A. However, this is not intended to be understood to be limiting. In principle, any desired assembly angles $\alpha$ can be provided. The only important factor is that the pushing-on operation or the assembly movement B does not take place in the insertion direction A of the compatible connector 3. In principle, the pushing-on operation can also take place along a specific assembly path and does not have to have a strictly linear profile, as illustrated in the exemplary embodiment.

Figure 2:
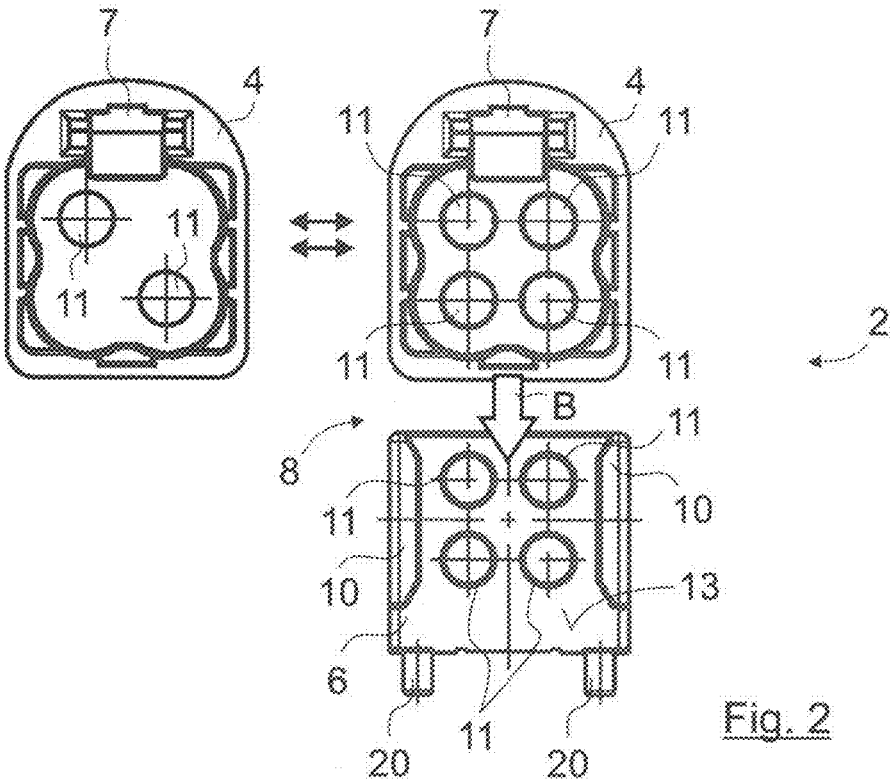
FIG. 2 schematically shows a front view of the electrical connector in accordance with the teachings of the present disclosure from FIG. 1 with coding housings which can be exchanged in a modular manner.

The connector 2 illustrated in FIG. 1 is illustrated in a front view separately from the connector system 1 of FIG. 1 in FIG. 2. The said FIG. 2 shows that, in the plug body 6, in each case two guide rails 10, which run in parallel, are arranged so as to run at opposite ends of the connecting face 13 of the plug body 6, the said two guide rails corresponding to guide rails 9 of the coding housing 4, which guide rails 9 correspondingly run in parallel and are likewise arranged at opposite ends of the connecting face 13 (not illustrated). A particularly suitable guide can be provided owing to the use of in each case two guide rails 9, 10. The rail system and, respectively, the guide rails 9, 10 and the arrangement thereof are particularly clearly shown in FIGS. 9 to 11 which are still to be explained below.

Furthermore, recesses 11 for at least one contact body 12, which is still to be described below, are provided in the coding housing 4 and in the plug body 6, the said recesses preferably being oriented towards one another in an end position of the coding housing 4.

FIG. 2 further illustrates an additional advantage of the connector 2. On account of the two-part and nevertheless robust design, the connector 2 can be used in a modular construction system where a fitter can very easily select a desired coding housing 4 from a number of different coding housings 4 and then connects the said coding housing to the plug body 6 by way of the mechanical connecting device 8. In this case, the positions of the recesses 11 for the at least one contact body 12 preferably correspond; however, this is not absolutely necessary. By way of example, instead of a quadruple design or a coding housing 4 which is provided for use with four contact bodies 12, a fitter can also select a coding housing 4 which is provided for use with only two contact bodies 12. Furthermore, the mechanical coding can distinguish between different coding housings 4, as a result of which the compatibility with the compatible connector 3 can be easily determined by a fitter.

In principle, the assembly movement B, in particular in respect of a pushing-on operation along a rail system, can take place in any desired direction (except for in or counter to the insertion direction A). This is illustrated by way of example in FIGS. 3 and 4.

Figure 3:
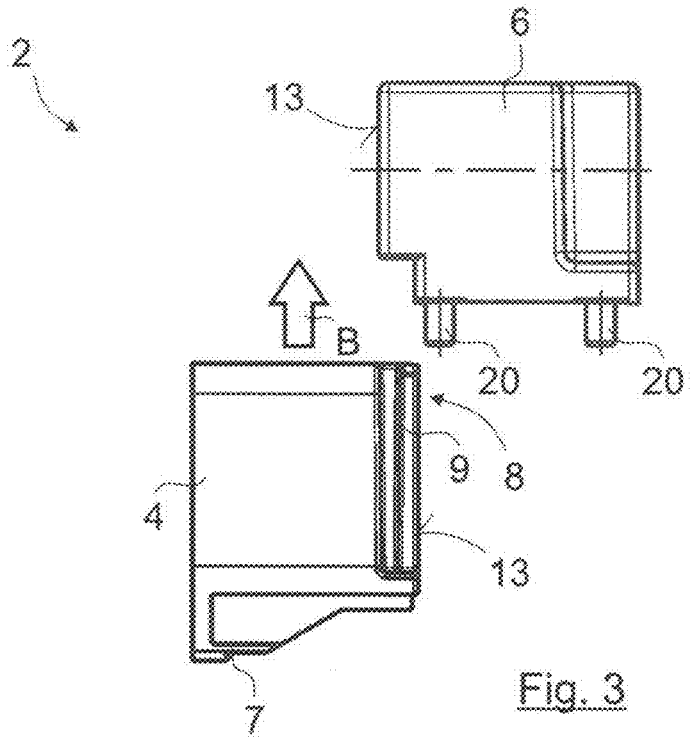
FIG. 3 schematically shows a side view of the electrical connector in accordance with the teachings of the present disclosure from FIG. 1 with an alternative assembly movement for mounting the coding housing on the plug body.

In FIG. 3, the coding housing is likewise pushed on at an assembly angle $\alpha$ of 90° in relation to the insertion direction A, but in the opposite direction compared with FIG. 1.

Figure 4:
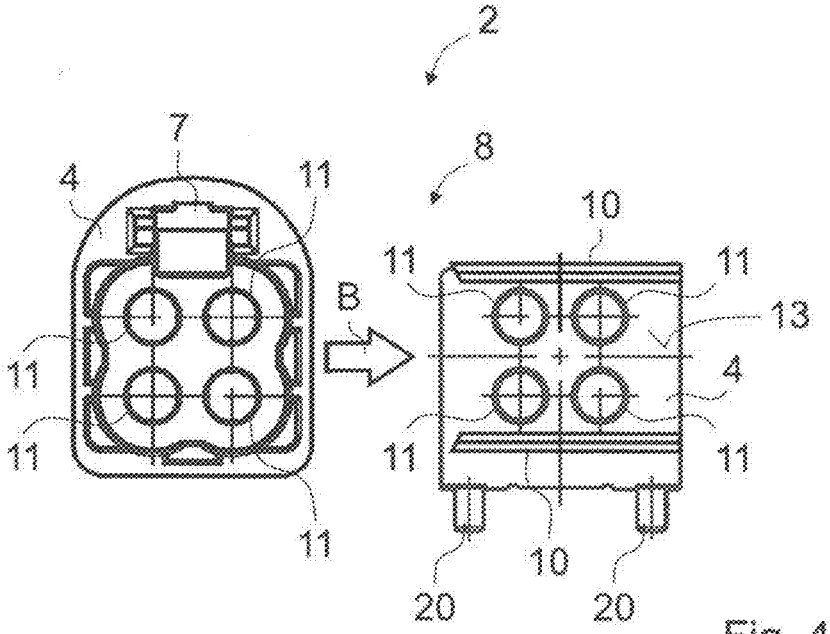
FIG. 4 schematically shows a front view of an electrical connector in accordance with the teachings of the present disclosure in a second embodiment with a further exemplary assembly movement for mounting the coding housing on the plug body.

FIG. 4 shows a variant of an assembly movement B by way of a pushing-on operation from the side, wherein the rail system is rotated through 90° compared with FIGS. 1 to 3. The assembly movement B takes place orthogonally or at an assembly angle $\alpha$ of 90° relative to the insertion direction A in this embodiment too. In principle, the rail system can be oriented at any desired angle to the connecting faces 13 of the coding housing 4 and, respectively, the plug body 6.

As already indicated above, the invention and, respectively, the connector 2 may be suitable for a large number of applications. For example, the plug body 6 of the connector 2, which is shown in an angular embodiment in FIGS. 1 to 4, can also be designed in a straight embodiment. A straight embodiment is illustrated in FIGS. 5 to 8.

Figure 5:
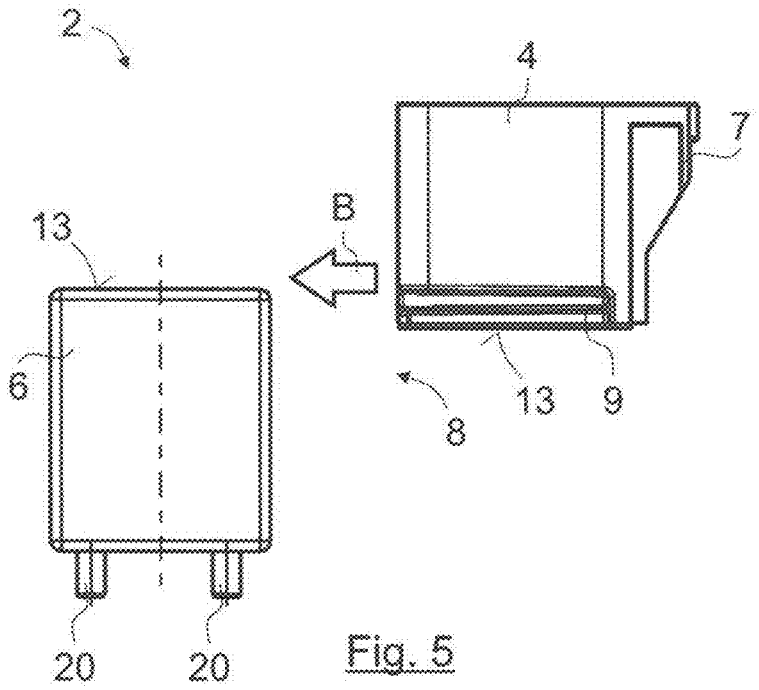
FIG. 5 schematically shows a side view of an electrical connector in accordance with the teachings of the present disclosure in an embodiment as a straight printed circuit board connector.

FIG. 5 shows a straight printed circuit board connector which is designed for electrical and mechanical connection to a circuit board 5 (not illustrated here).

Figure 6:
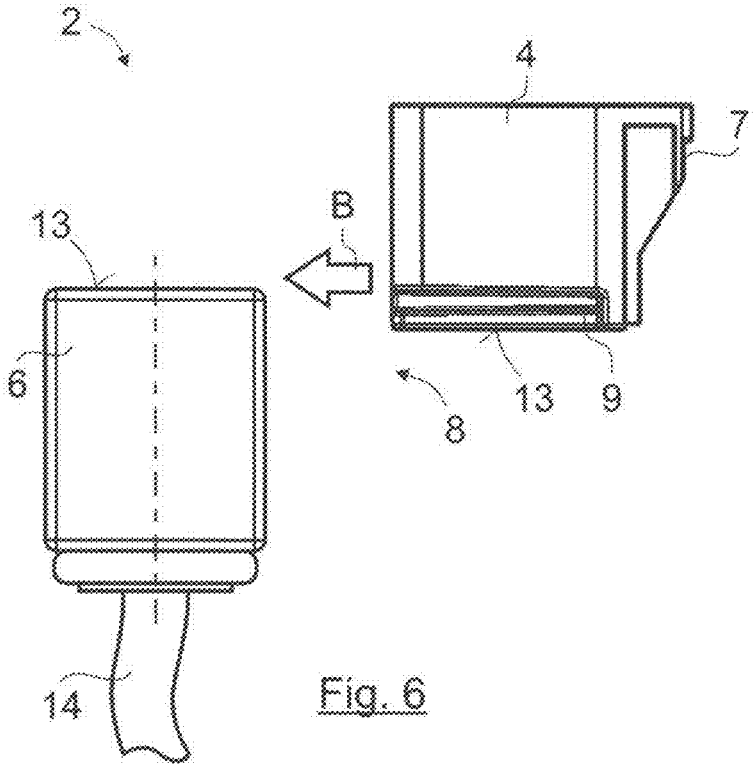
FIG. 6 schematically shows a side view of an electrical connector in accordance with the teachings of the present disclosure in an embodiment as a plug of a cable.

FIG. 6 shows a connector 2 which is designed as a plug and which is designed for electrical and mechanical connection to an electrical assembly which is designed as an electrical cable 14. It goes without saying that, instead of a plug, a socket or a coupling can also be provided in connection with an electrical cable 14.

Figure 7:
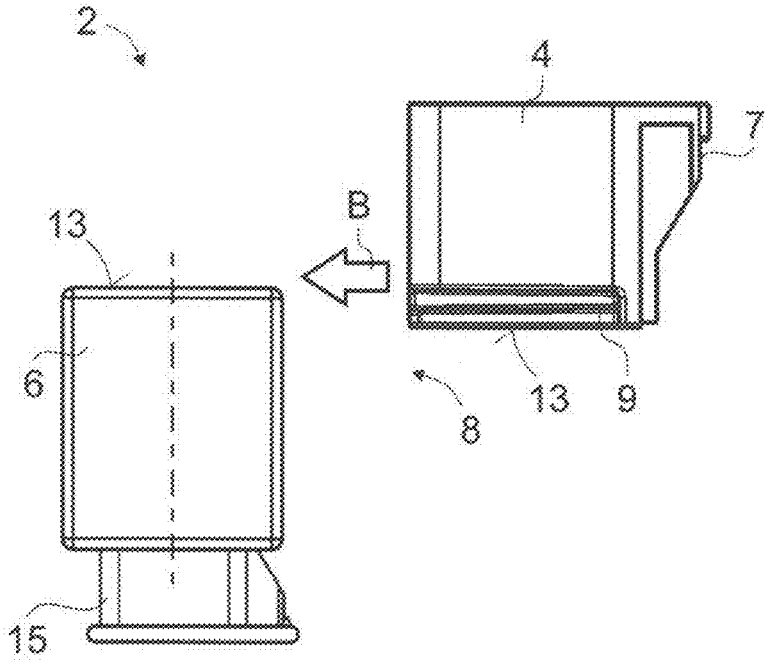
FIG. 7 schematically shows a side view of an electrical connector in accordance with the teachings of the present disclosure in an embodiment as an adapter having an adapter coding housing.

FIG. 7 shows the electrical connector 2 as an adapter, wherein the plug body 6 is realized for electrical and mechanical connection to an electrical assembly which is designed as an adapter part 15. In the present case, the adapter part 15 is an adapter coding housing which has, for example, a mechanical coding, which differs from the coding housing 4, and/or an electrical configuration in order to connect a complementary connector (not illustrated) to the compatible connector 3 in the manner of an adapter. In this case, it can particularly also be provided that the adapter part 15 and the plug body 6 form a second connecting device (not illustrated), as a result of which the adapter part 15 can also be connected to the plug body 6. However, the plug body 6 can also be integrally formed with the adapter part 15 or can be connected to the adapter part 15 in some other way.

Figure 8:
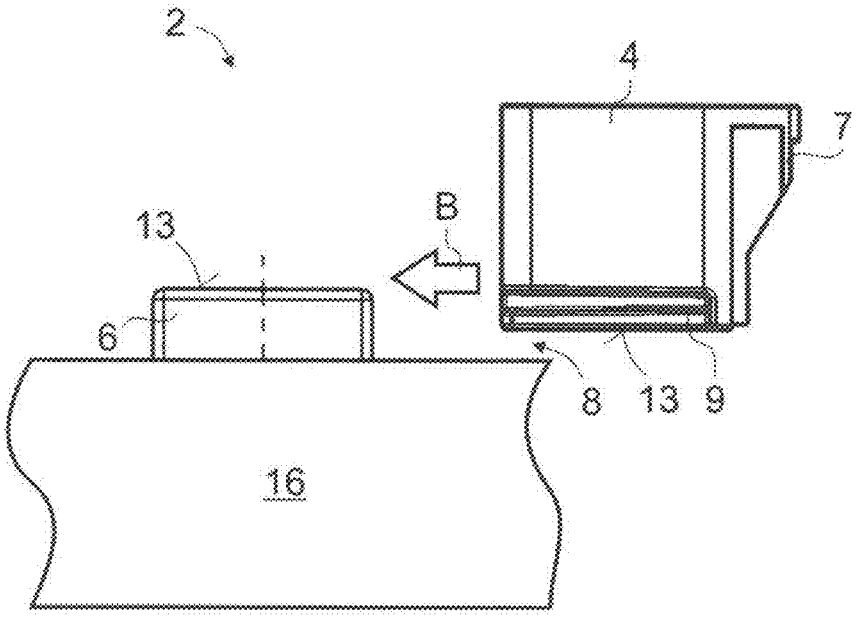
FIG. 8 schematically shows a side view of an electrical connector in accordance with the teachings of the present disclosure in an embodiment as a device plug.

FIG. 8 finally shows the connector 2 as a housing plug, wherein the plug body 6 is realized for electrical and mechanical connection to an electrical assembly which is designed as a device housing 16.

Figure 9:
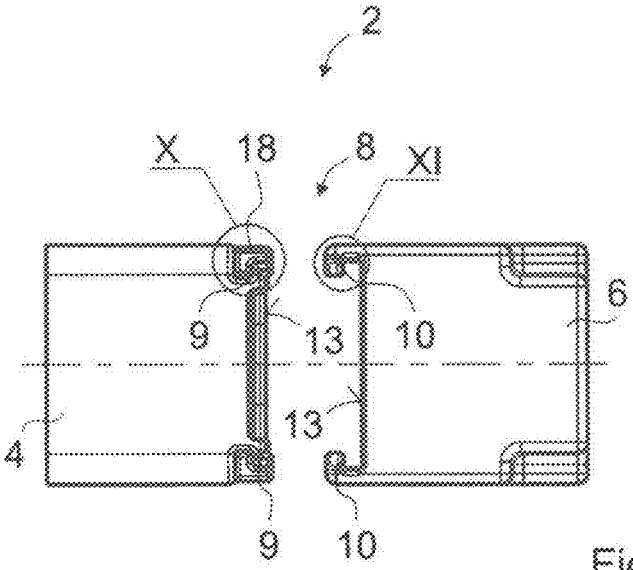
FIG. 9 schematically shows a plan view of the electrical connector in accordance with the teachings of the present disclosure from FIG. 1.
Figure 10:
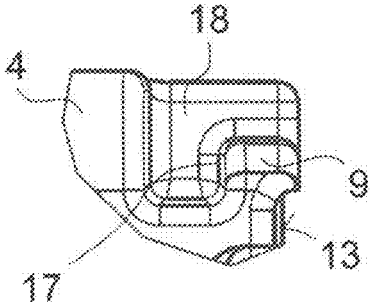
FIG. 10 schematically shows an enlarged illustration of detail "X" from FIG. 9 for illustrating a guide rail of the coding housing.
Figure 11:
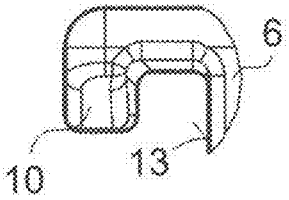
FIG. 11 schematically shows an enlarged illustration of detail "XI" from FIG. 9 for illustrating a guide rail of the plug body.

FIG. 9 shows a separate plan view of the connector 2 of the connector system 1 from FIG. 1, as a result of which the connecting device 8 and, respectively, the rail system are shown particularly clearly. As already stated, the coding housing 4 and the plug body 6 respectively have two guide rails 9, 10 which run in parallel and at opposite ends of the connecting faces 13. FIGS. 10 and 11 show corresponding enlarged illustrations of a guide rail 9 of the coding housing 4 and a guide rail 10 of the plug body 6 respectively.

In principle, any desired guide can be provided, but a rail system is particularly suitable. Finally, the rail system can be realized in virtually any desired manner, for example, as illustrated in FIGS. 9 to 11, as interengaging elements or by the plug body 6 having guide rails 10 which are arranged in a clamp-like manner and engage behind corresponding grooves 17 of the guide rails 9 of the coding housing 4. T-shaped webs which make it possible to engage behind corresponding grooves of the mating piece are also possible.

As shown in FIGS. 9 and 10, the guide rails 9 of the coding housing 4 have end stops 18 which define an end position of the coding housing 4 on the plug body 6 for the assembly movement B. In principle, the connecting device 8 can comprise any desired end stop 18. It can also be provided that the plug body 6 or the coding housing 4 has end stops.

Figure 12:
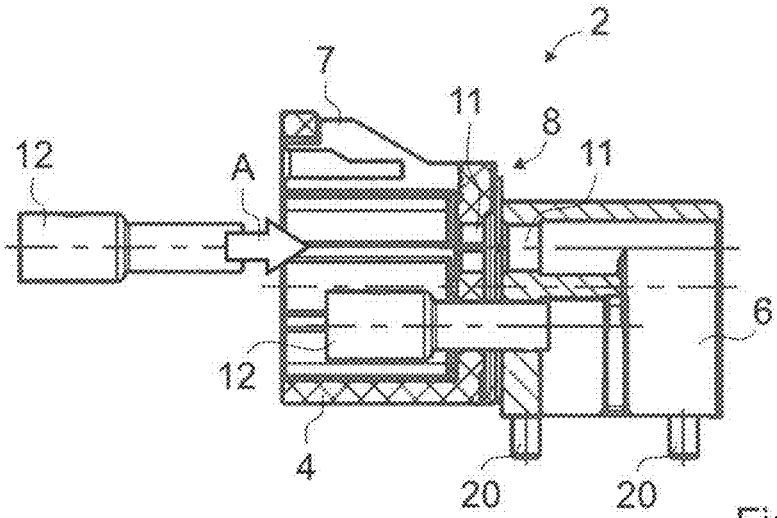
FIG. 12 schematically shows a sectioned side illustration of the electrical connector from FIG. 1 during an assembly step for introducing contact bodies.

FIG. 12 shows a further assembly step which preferably—but not necessarily—follows the above-described assembly step for establishing the mechanical connection between the coding housing 4 and the plug body 6. In this case, contact bodies 12 are introduced into the connector 2 through corresponding recesses 11 in the coding housing 4 and in the plug body 6 in the insertion direction A in such a way that the relative position between the coding housing 4 and the plug body 6 is fixed. The corresponding recesses 11 are clearly shown in a front view in FIG. 2 which has already been described above. FIG. 12 shows a first contact body 12 already mounted in the electrical connector 2, whereas a second contact body 12 is in a position in which it has not yet been mounted.

Figure 13:
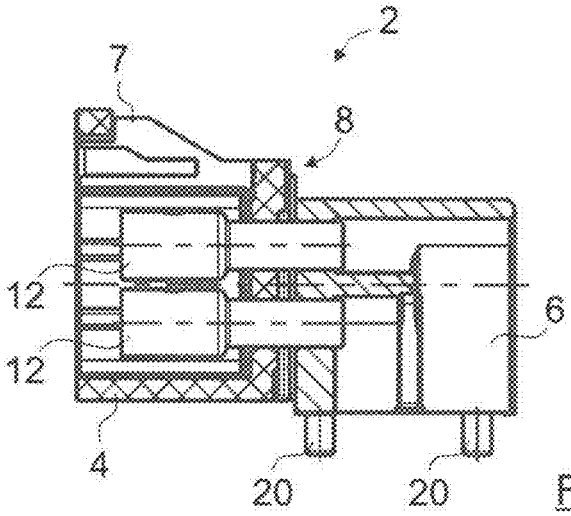
FIG. 13 schematically shows a sectioned side illustration of the electrical connector from FIG. 12 with fully introduced contact bodies.

All of the contact bodies 12 are mounted in the electrical connector 2 in FIG. 13. On account of the coding housing 4 and the plug body 6 already being connected to one another in an interlocking manner in the insertion direction A by the connecting device 8, the rail system and, respectively, the connecting device 8 can be blocked by insertion of the contact bodies 12 or even by the insertion of a single contact body 12, as a result of which the position between the coding housing 4 and the plug body 6 is defined in all spatial directions. In principle, the coding housing 4 and/or the plug body 6 can be designed in order to receive one to ten contact bodies 12, preferably two to six contact bodies 12 and very particularly preferably four contact bodies 12.

The at least one contact body 12 can be introduced by being pressed, soldered, welded, fused and/or adhesively bonded in the plug body 6 or the receptacle 11 thereof. The at least one contact body 12 is preferably pressed in the plug body 6 or the associated receptacle 11.

The cross section of the contact body 12 can have a stepped design, as illustrated, in such a way that a stop is formed, which stop limits the pushing-in of the contact body 12 into the receptacle 11 of the plug body 6.

Figure 14:
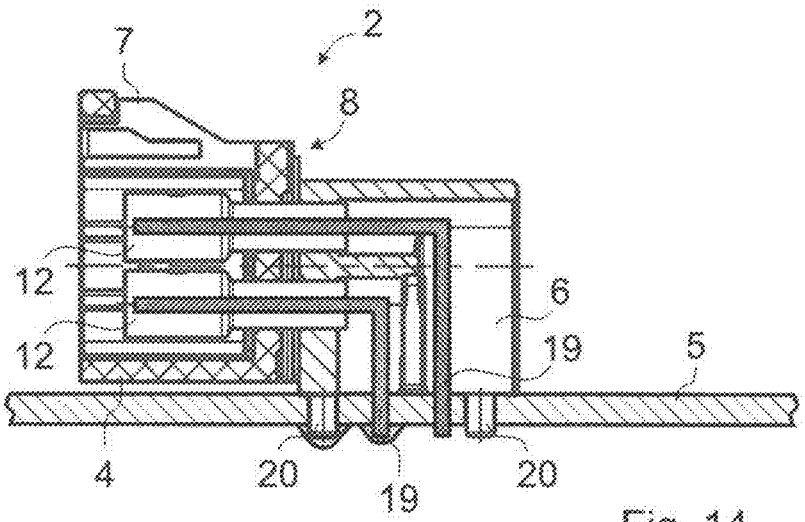
FIG. 14 schematically shows a sectioned side illustration of the electrical connector in accordance with the teachings of the present disclosure from FIG. 13, partially soldered onto a printed circuit board and with introduced inner conductors.

The at least one contact body 12 can preferably be designed as a tubular outer conductor or as a contact sleeve and for receiving in each case at least one inner conductor part 19 (cf. FIG. 14). In the exemplary embodiment, the contact bodies 12, which are designed as outer conductors or earth conductors, are pressed with the plug body 6 which is preferably designed from metal, in particular as a die-cast zinc part. As a result, the outer conductors for shielding the inner conductor parts 19, still to be described below, can be electrically connected to the plug body 6 and then to the electrical assembly, for example an earth line of a printed circuit board 5 or an outer conductor of an electrical cable 14.

In a preferably further assembly step, the one inner conductor part 19 or the plurality of inner conductor parts 19 can be introduced into the connector 2. The said inner conductor parts can preferably be pushed into the contact bodies 12, which are designed as contact sleeves, from the rear side of the plug body 6. The inner conductor parts 19—depending on the embodiment of the connector 2 as a straight or angled connector 2—can likewise be of straight or angled design. A dielectric (not illustrated) can preferably be provided for establishing electrical insulation between the inner conductor parts 19.

A connector 2 which is assembled in such a way is then usually electrically and mechanically connected to the electrical assembly, in the present case a printed circuit board 5. This is indicated in FIG. 14. In this case, an earth connection can first be established with the printed circuit board 5 by soldering the contact feet 20 of the plug body 6, as a result of which the plug body 6 is able to electrically shield the received inner conductor parts 19 and in this way possibly also make contact with the contact bodies 12 which are designed as outer conductors. Furthermore, the inner conductor parts 19 can be connected (for example soldered) to corresponding conductor tracks (not illustrated) of the printed circuit board 5.

Although the present invention has been described above in full on the basis of preferred exemplary embodiments, it is not limited thereto but able to be modified in many ways.

The present disclosure may be summarized as disclosing, inter alia, the following Embodiments.

Embodiment 1

Electrical connector (2) comprising a coding housing (4) for electrical and mechanical connection to a compatible connector (3) and comprising a plug body (6) for electrical and mechanical connection to an electrical assembly (5, 14, 15, 16), wherein the compatible connector (3) can be connected to the coding housing (4) along an insertion direction (A), and wherein the coding housing (4) and the plug body (6) have a mechanical connecting device (8), characterized in that the connecting device (8) is designed in order to connect the coding housing (4) and the plug body (6) to one another in an interlocking manner in the insertion direction (A), wherein the connecting device (8) prespecifies an assembly movement (B), which differs from the insertion direction (A), in order to connect the coding housing (4) and the plug body (6) to one another.

Embodiment 2

Connector (2) according to Embodiment 1, wherein the connecting device (8) comprises a rail system, wherein the coding housing (4) and the plug body (6) each have at least one guide rail (9, 10), which guide rails correspond to one another and together form the rail system.

Embodiment 3

Connector (2) according to Embodiment 2, wherein two guide rails (9, 10) which run in parallel and on opposite sides are arranged in the coding housing (4) and in the plug body (6) in each case.

Embodiment 4

Connector (2) according to one of Embodiments 1 to 3, wherein the connecting device (8) comprises an end stop (18) which defines an end position of the coding housing (4) on the plug body (6) for the assembly movement (B).

Embodiment 5

Connector (2) according to one of Embodiments 1 to 4, wherein the assembly movement (B) takes place along an assembly angle ($\alpha$), wherein the assembly angle ($\alpha$) is 30° to 150°, preferably 45° to 135°, particularly preferably 80° to 100° and very particularly preferably 90°, relative to the insertion direction (A).

Embodiment 6

Connector (2) according to one of Embodiments 1 to 5, wherein recesses (11) for at least one contact body (12) are provided in the coding housing (4) and in the plug body (6) in order to introduce the at least one contact body (12) into the plug body (6) through the coding housing (4) in the insertion direction (A), wherein the contact body (12) and the recesses (11) are created in such a way that the coding housing (4) and the plug body (6) are fixed in position in relation to one another by virtue of the introduction of the contact body (12).

Embodiment 7

Connector (2) according to Embodiment 6, wherein the plug body (6) is designed to receive one or more inner conductor parts (19), wherein the at least one contact body (12) is designed as a tubular outer conductor and to receive at least one of the several inner conductor parts (19).

Embodiment 8

Connector (2) according to either of Embodiments 6 and 7, wherein the coding housing (4) and/or the plug body (6) are/is designed in order to receive one to ten contact bodies (12), preferably two to six contact bodies (12) and very particularly preferably four contact bodies (12).

Embodiment 9

Connector (2) according to one of Embodiments 6 to 8, wherein the plug body (6) is designed from metal, preferably as a die-cast zinc part, and is electrically conductively connected to the at least one contact body (12).

Embodiment 10

Connector (2) according to one of Embodiments 1 to 9, wherein the plug body (6) is designed for electrical and mechanical connection to an electrical assembly which is designed as a printed circuit board (5), electrical cable (14), adapter part (15) or device housing (16).

Embodiment 11

Connector (2) according to one of Embodiments 1 to 10, wherein the coding housing (4) has latching means (7) for latching connection to the compatible connector (3).

Embodiment 12

Method for assembling an electrical connector (2) which has a coding housing (4) for electrical and mechanical connection to a compatible connector (3) and has a plug body (6) for electrical and mechanical connection to an electrical assembly (5, 14, 15, 16), wherein the coding housing (4) is mechanically connected to the plug body (6) in one assembly step, wherein the assembly step for establishing the mechanical connection between the coding housing (4) and the plug body (6) comprises an assembly movement (B) of the coding housing (4) relative to the plug body (6), by way of which assembly movement the coding housing (4) and the plug body (6) are connected to one another in an interlocking manner in the insertion direction (A) of the compatible connector (3).

Embodiment 13

Method according to Embodiment 12, wherein the assembly movement (B) comprises pushing the coding housing (4) onto the plug body (6) and/or rotating the coding housing (4) in relation to the plug body (6).

Embodiment 14

Method according to Embodiment 13, wherein the coding housing (4) is pushed onto the plug body (6) using a rail system, wherein the coding housing (4) and the plug body (6) each have at least one guide rail (9, 10), which guide rails correspond to one another.

Embodiment 15

Method according to either of Embodiments 13 and 14, wherein the pushing-on operation takes place along an assembly angle ($\alpha$), wherein the assembly angle ($\alpha$) is 30° to 150°, preferably 45° to 135°, particularly preferably 80° to 100° and very particularly preferably 90°, relative to the insertion direction (A).

Embodiment 16

Method according to one of Embodiments 12 to 15, wherein in a further assembly step, at least one contact body (12) is introduced through corresponding recesses (11) in the coding housing (4) and in the plug body (6) in the insertion direction (A) in such a way that the relative position between the coding housing (4) and the plug body (6) is fixed.

Embodiment 17

Method according to Embodiment 16, wherein the at least one contact body (12) is pressed, soldered, welded, fused and/or adhesively bonded in the recess (11) of the plug body (6).

Embodiment 18

Method according to either of Embodiments 16 and 17, wherein in a further assembly step, at least one inner conductor part (19) is passed through the plug body (6) and received by the at least one contact body (12).

Embodiment 19

Connector system (1) comprising an electrical connector (2) according to one of claims 1 to 12, a compatible connector (3) for electrical and mechanical connection to a coding housing (4) of the electrical connector (2) and an electrical assembly (5, 14, 15, 16) for electrical and mechanical connection to a plug body (6) of the electrical connector (2).

The invention claimed is:

1. A connector assembly, comprising:

a first housing of a conductive material;

a second housing;

a first inner conductor;

a first outer conductor that extends from an interior of said second housing to an interior of said first housing;

a second inner conductor; and a second outer conductor that extends from said interior of said second housing to said interior of said first housing, wherein said first housing comprises a plurality of feet that project from a first side of said first housing, said first inner conductor extends from an interior of said first outer conductor through said interior of said first housing and projects from said first side of said first housing, said second inner conductor extends from an interior of said second outer conductor through said interior of said first housing and projects from said first side of said first housing, said second housing is situated adjacent a second side of said first housing, said second side of said first housing being substantially perpendicular to said first side of said first housing, at least one of said first outer conductor and said second outer conductor inhibits a disengagement of said second housing from said first housing, said first outer conductor is electrically insulated from said first inner conductor, and said second outer conductor is electrically insulated from said second inner conductor.

2. The connector assembly of claim 1, wherein:

said second housing is of a plastic material.

3. The connector assembly of claim 1, wherein:

each of said first outer conductor and said second outer conductor electrically contacts said first housing.

4. The connector assembly of claim 1, wherein:

at least one of said first outer conductor and said second outer conductor has a stepped outer diameter.

5. The connector assembly of claim 1, wherein:

a first portion of said first outer conductor has a first diameter, a second portion of said first outer conductor has a second diameter that differs substantially from said first diameter, and said first portion is adjacent said second portion.

6. The connector assembly of claim 1, wherein:

said first outer conductor is coaxial to said first inner conductor, and said second outer conductor is coaxial to said second inner conductor.

7. The connector assembly of claim 1, comprising:

a connector comprising a third outer conductor, a third inner conductor, a fourth outer conductor and a fourth inner conductor, wherein said second housing comprises an opening at a side of said second housing opposite said second side of said first housing, said connector extends through said opening such that said third outer conductor electrically contacts said first outer conductor, said third inner conductor electrically contacts said first inner conductor, said fourth outer conductor electrically contacts said second outer conductor, and said fourth inner conductor electrically contacts said second inner conductor.

8. A connector assembly, comprising:

a first housing of a conductive material;

a second housing;

a first inner conductor;

a first outer conductor coaxial to a second end of said first inner conductor;

a second inner conductor; and a second outer conductor coaxial to a second end of said second inner conductor, wherein a first end of said first outer conductor terminates in an interior of said first housing, a second end of said first outer conductor terminates in an interior of said second housing, a first end of said second outer conductor terminates in an interior of said first housing, a second end of said second outer conductor terminates in an interior of said second housing, said first housing comprises a plurality of feet that project from said first housing in a first direction, a first end of said first inner conductor projects from said first housing in said first direction, said second end of said first inner conductor projects from said first housing in a second direction and terminates in an interior of said first outer conductor in an interior of said second housing, said second direction being substantially perpendicular to said first direction, a first end of said second inner conductor projects from said first housing in said first direction, said second end of said second inner conductor projects from said first housing in said second direction and terminates in an interior of said second outer conductor in an interior of said second housing, said first outer conductor engages said first housing in a manner that inhibits a motion of said second housing relative to said first housing, said second outer conductor engages said first housing in a manner that inhibits a motion of said second housing relative to said first housing, said first outer conductor is distinct from said first housing and said second housing, and said second outer conductor is distinct from said first housing and said second housing.

9. The connector assembly of claim 8, wherein:

said second housing is of a plastic material.

10. The connector assembly of claim 8, wherein:

each of said first outer conductor and said second outer conductor electrically contacts said first housing.

11. The connector assembly of claim 8, wherein:

said first outer conductor has a generally cylindrical shape excepting a first step in outer diameter, said second outer conductor has a generally cylindrical shape excepting a second step in outer diameter, and said first step in outer diameter and said second step in outer diameter are situated in said interior of said second housing.

12. The connector assembly of claim 8, wherein:

said first end of said first outer conductor has a first outer diameter, said second end of said first outer conductor has a second outer diameter that is substantially larger than said first outer diameter, and an outer surface of said first outer conductor transitions abruptly, in said interior of said second housing, from said first outer diameter to said second outer diameter.

13. The connector assembly of claim 8, wherein:

said first outer conductor is insulated from said first inner conductor, and said second outer conductor is insulated from said second inner conductor.

14. The connector assembly of claim 8, comprising:

a connector comprising a third outer conductor, a third inner conductor, a fourth outer conductor and a fourth inner conductor, wherein said first housing is situated adjacent a first side of said second housing, said second housing comprises an opening in a second side of said second housing opposite said first side, said connector extends through said opening such that said third outer conductor electrically contacts said first outer conductor, said third inner conductor electrically contacts said first inner conductor, said fourth outer conductor electrically contacts said second outer conductor, and said fourth inner conductor electrically contacts said second inner conductor.

15. A connector assembly method, comprising:

positioning a first housing of a conductive material immediately adjacent a second housing, inserting, via a first hole in a first wall of said second housing subsequent to said positioning, a first end of a first outer conductor of a first pair of coaxial conductors into a first hole in a first wall of said first housing, and inserting, via a second hole in said first wall of said second housing subsequent to said positioning, a first end of a second outer conductor of a second pair of coaxial conductors into a second hole in said first wall of said first housing, wherein at least one of said first outer conductor and said second outer conductor electrically contacts said first housing and inhibits a motion of said second housing relative to said first housing.

16. The connector assembly method of claim 15, comprising:

assembling a first inner conductor of said first pair of coaxial conductors relative to said first housing such that a first end of said first inner conductor projects from said first housing in a first direction and a second end of said first inner conductor projects from said first housing in a second direction substantially perpendicular to said first direction and terminates in an interior of said first outer conductor in an interior of said second housing, and assembling a second inner conductor of said second pair of coaxial conductors relative to said first housing such that a first end of said second inner conductor projects from said first housing in said first direction and a second end of said second inner conductor projects from said first housing in said second direction and terminates in an interior of said second outer conductor in an interior of said second housing.

17. The connector assembly method of claim 16, comprising:

soldering said first inner conductor to a first conductive trace of a printed circuit board, and soldering a foot of said first housing to a second conductive trace of said printed circuit board, wherein said foot projects from said first housing in said first direction.

18. The connector assembly method of claim 15, wherein:

said second housing is of a plastic material, each of said first inner conductor and said second inner conductor is substantially L-shaped, said first outer conductor is insulated from said first inner conductor, and said second outer conductor is insulated from said second inner conductor.

19. The connector assembly method of claim 15, wherein:

each of said first outer conductor and said second outer conductor has a generally cylindrical shape excepting a step in outer diameter.

20. The connector assembly method of claim 15, comprising:

inserting a connector into said second housing such that a third outer conductor of said connector comes into electrical contact with said first outer conductor, a third inner conductor of said connector comes into electrical contact with said first inner conductor, a fourth outer conductor of said connector comes into electrical contact with said second outer conductor, and a fourth inner conductor of said connector comes into electrical contact with said second inner conductor.

* * * * *